US006739709B2

(12) United States Patent
Nip

(10) Patent No.: US 6,739,709 B2
(45) Date of Patent: May 25, 2004

(54) INK CARTRIDGE SEALING MEMBER

(75) Inventor: Shui Kuen Nip, North Point (HK)

(73) Assignee: Cyber Imaging Limited, North Point (HK)

( * ) Notice: Subject to any disclaimer, the term of this patent is extended or adjusted under 35 U.S.C. 154(b) by 0 days.

(21) Appl. No.: 10/184,931

(22) Filed: Jul. 1, 2002

(65) Prior Publication Data

US 2004/0001127 A1 Jan. 1, 2004

(51) Int. Cl.[7] ..... B41J 2/175
(52) U.S. Cl. ..... 347/86
(58) Field of Search ..... 347/20, 56, 61, 347/63, 65, 67, 84–87

(56) References Cited

U.S. PATENT DOCUMENTS 5,790,158 A * 8/1998 Shinada et al. ..... 347/86
6,435,674 B1 * 8/2002 Michele et al. ..... 347/86

OTHER PUBLICATIONS

J. Greene, W. Hildenbrand and S. Manning, "Constant Pressure Head Ink Supply", Feb. 2973, IBM (Technical Disclosure Bulletin), Vo. 15, No. 9.*

J. Greene, W. Hildenbrand and S. Manning, "Constant–Pressure Head Ink Supply", Feb. 1973, IBM (Technical Disclosure Bulletin), Vo. 15, No. 9*

* cited by examiner

*Primary Examiner*—Juanita D. Stephens
(74) *Attorney, Agent, or Firm*—Leydig, Voit & Mayer, Ltd.

(57) ABSTRACT

A resilient seal for insertion into an ink delivery port of an ink cartridge of an inkjet printer includes a blind hole through which an ink supply needle of the printer can pass. A membrane is formed integrally with the seal and closes the blind hole. The ink supply needle penetrates the membrane when the cartridge is inserted into the printer. The penetration in the membrane closes automatically upon removal of the cartridge from the printer.

13 Claims, 2 Drawing Sheets

DIRECTION IV

INK CARTRIDGE SEALING MEMBER

BACKGROUND OF THE INVENTION

The present invention relates to a sealing member for an ink cartridge. More particularly, although not exclusively, the invention relates to a resilient member for sealing the ink-delivery port of an ink cartridge used in an inkjet printer.

Inkjet printers include a printhead associated with a cradle into which an ink cartridge is mounted. The printhead has associated with it an ink supply needle, which fits into the ink delivery port when the cartridge is installed in the cradle. Ink passes from the ink cartridge through the ink supply needle to the printhead on demand.

Known ink cartridges have a rubber seal mounted at the ink-delivery port, having a small aperture therein which bears tightly against the ink supply needle to prevent leakage during use. However, when the empty or partially depleted ink cartridge is removed from the cradle and the seal is lifted with it from the ink supply needle, the aperture in the seal remains open due to its inherent shape as manufactured. This leads to messy dripping of any unspent ink from within the cartridge through the aperture.

Also, such known rubber seals allow air to enter the ink chamber prior to use unless a separate peel-off sticker remains in place over the seal. Also, after removal of the cartridge from the cradle, if a proper airtight seal is required, a piece of tape or other adhesive must be placed over the port and the seal. This is inconvenient where it is desired to repeatedly remove and replace the ink cartridge, say for the purpose of refilling the cartridge with ink

OBJECTS OF THE INVENTION

It is an object of the present invention to overcome or substantially ameliorate at least one of the above disadvantages.

It is a further object of the present invention to provide a seal for an ink delivery port of an ink cartridge that not only allows a flow of ink through an ink supply needle therethrough during use of the cartridge in a printer, but also prevents a flow of fluid therepast when the cartridge is not installed in the printer.

It is a further object of the present invention to provide an improved seal for an ink delivery port of an ink cartridge that is capable of sealing closed after repeated insertion and removal of the ink cartridge to/from a printer having an ink delivery needle that passes into the ink delivery port in use.

DISCLOSURE OF THE INVENTION

There is disclosed therein a resilient seal for insertion into an ink delivery port of an ink cartridge of an inkjet printer, comprising:

- a blind hole through which an ink supply needle of the printer can pass when the cartridge is inserted into the printer, and
- closing means closing the blind hole upon removal of the cartridge from the printer.

Preferably, the seal further comprises:

- a membrane formed integrally with the seal and closing the blind hole, wherein
  - the membrane is penetrated by the ink supply needle when the cartridge is inserted into the printer and said closing means closes the penetration in the membrane upon removal of the cartridge from the printer.

Preferably the blind hole has opposed walls against which the needle bears.

Preferably the opposed walls converge toward the membrane.

Preferably the opposed walls are flat.

Preferably be blind hole has a tapered opening.

Preferably the seal includes an outer wall defining a space within which the blind hole and membrane are located.

Preferably a pair of ribs extend between the outer wall and a respective one of the opposed walls, serving to bias the membrane to close the penetration.

Preferably the seal is substantially circular.

Alternatively, the seal is slightly elliptical such that upon insertion into a circular ink delivery port, the ribs press against the opposed walls.

Preferably the seal has at least one sealing ring formed integrally therewith and about the outer wall.

There is further disclosed therein an ink cartridge having an ink delivery port into which the above disclosed seal is inserted.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 3:
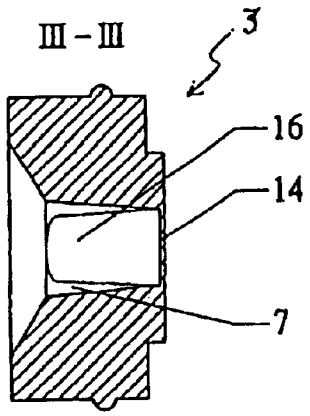
FIG. 3 is a schematic cross-sectional view of the seal taken at III—III in FIG. 1.
Figure 1:
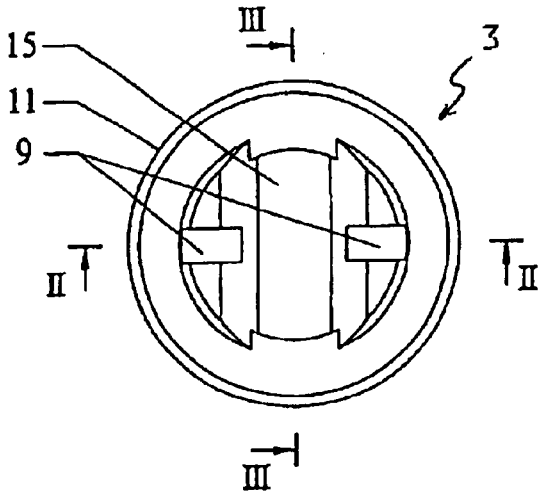
FIG. 1 is a schematic plan view of a resilient seal.

In the accompanying drawings there is schematically depicted a resilient seal 3, typically formed of rubber. However, the seal could be formed of other resilient material such is synthetic plastics. In the preferred embodiments, the seal is substantially cylindrical as shown in FIG. 1 or slightly elliptical.

Figure 5:
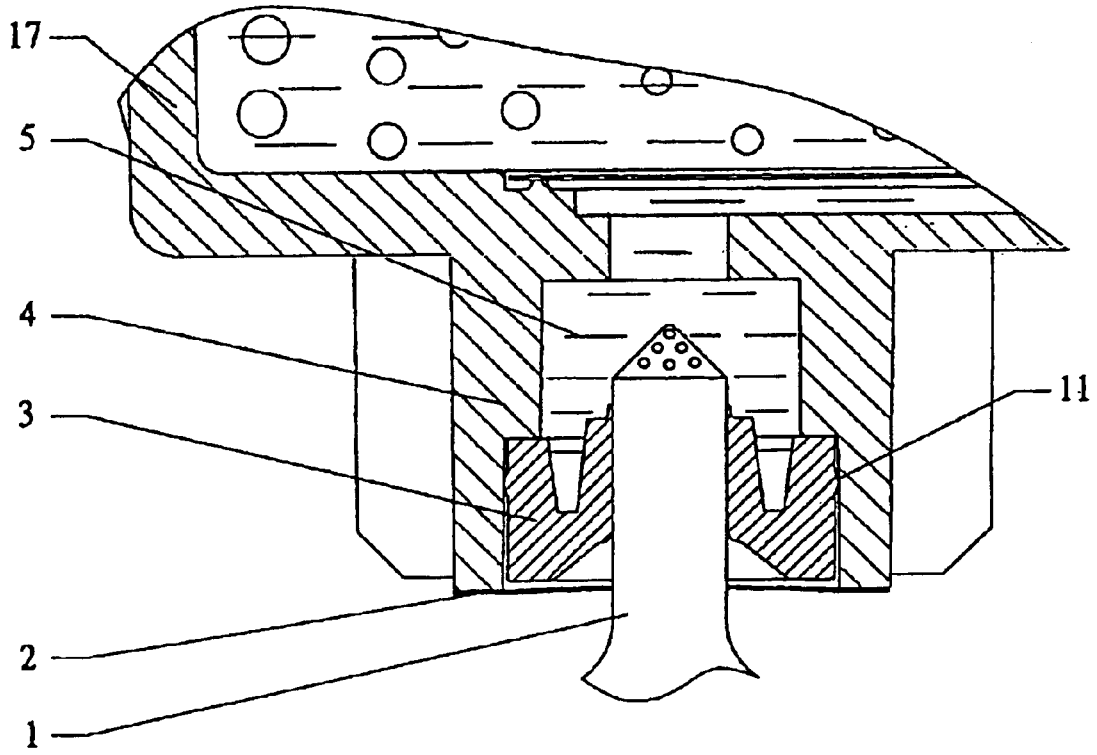
FIG. 5 is a schematic cross-sectional elevational view of an ink supply port of and ink cartridge having fitted thereto the seal of FIGS. 1 to 4 and having an ink supply needle of the printer engaging therewith.

The seal includes a sealing ring 11 formed integrally with its outer wall 10. The sealing ring 11 bears tightly against the circular inside edge of the ink supply port 2 as shown in FIG. 5.

The seal 3 includes a bottom face 13 surrounding a tapered opening 6 that leads to a blind hole 7. By "blind hole" it is meant that the hole 7 is closed by something. In the depicted embodiment, a thin membrane 14 closes the hole 7.

At either side of the blind hole 7, there is a flat wall 16. These flat walls converge toward the membrane 14.

The flat walls 16 define a prism having a flat top 15.

Figure 2:
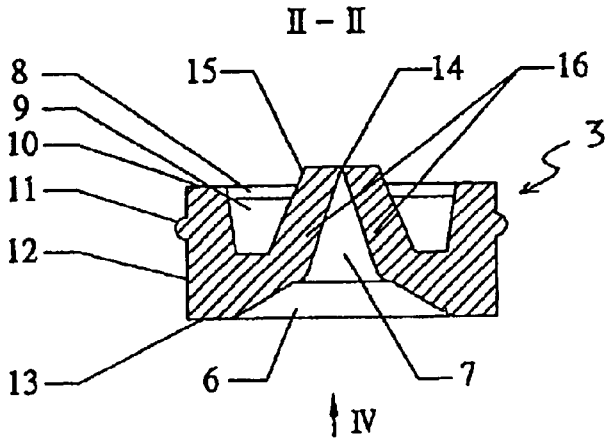
FIG. 2 is a schematic cross-sectional view of the seal of FIG. 1 taken at II—II in FIG. 1.

Between the outer wall 10 and each flat wall 16, there is provided a rib 9. The ribs 9 serve to bias the flat walls 16 into the position depicted in FIG. 2. In the alternate design, the ribs 9 lie along the broader dimension of the elliptical seal. This further assists in providing bias to the flat walls 16 when the seal is inserted into a circular ink delivery port 4.

In FIG. 5, an ink cartridge 17 having and ink delivery port 4 has a seal 3 inserted into it. The ink cartridge 17 is depicted in situ in a printer (typically directly upon a printhead) wherein an ink supply needle 1 is passing through the blind hole 7. To this end, the cartridge 17 is inserted into the printer cradle whereupon the seal 3 is forced over the ink supply needle 1. The tapered opening 6 assists in guiding the tip of the ink supply needle into the blind hole 7. The needle then penetrates the membrane 14 and the flat walls 16 bear tightly against the outside surface of the needle. The ribs 9 assist this seal by bearing against the flat walls.

Figure 4:
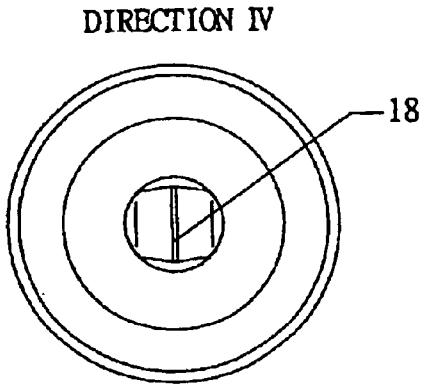
FIG. 4 is a schematic close-up view taken at IV in FIG. 2.

Upon depletion of ink 5 from within the cartridge 17, the cartridge can be removed from its cradle whereupon the ink supply needle 1 is withdrawn from the blind hole 7. The resilience of the material from which the seal is moulded and the action of the support ribs 9 close the membrane 14 to prevent dripping of any ink remnants from within the cartridge. It should be noted in this regard is that the flat walls 16 converge toward the membrane to provide a very thin strip 18 (FIG. 4) so that leakage is prevented.

It should be appreciated that modifications and alterations obvious to those skilled in the art are not to be considered as beyond the scope of the present invention. For example, the flat walls 16 could instead be of conical form converging to a small circle instead of a slit 18, Two, three or more ribs 9 could extend radially about such a conical wall. Furthermore, the membrane 14 might have a pre-formed slit or aperture therein through which the ink delivery needle can pass. As a result, the needle would not have to pierce the membrane on first installation of the ink cartridge into the printer.

What is claimed is:

1. A resilient seal for insertion into an ink delivery port of an ink cartridge of an inkjet printer, comprising:

a blind hole through which an ink supply needle of the printer can pass when the cartridge is inserted into the printer, closing means closing the blind hole upon removal of the cartridge from the printer, and a membrane formed integrally with the seal and closing the blind hole, wherein the membrane is penetrated by the ink supply needle when the cartridge is inserted into the printer and said closing means closes the penetration in the membrane upon removal of the cartridge from the printer.

2. The seal of claim 1, wherein the blind hole has opposed walls against which the needle bears.

3. The seal of claim 2, wherein the opposed walls converge toward the membrane.

4. The seal of claim 3, wherein the opposed walls are flat.

5. The seal of claim 1, wherein the blind hole has a tapered opening.

6. The seal of claim 1 further including an outer wall defining a space within which the blind hole and membrane are located.

7. The seal of claim 6, wherein a pair of ribs extend between the outer wall and a respective one of the opposed walls, serving to bias the membrane to close the penetration.

8. The seal of claim 6 having a sealing ring formed integrally therewith and about the outer wall.

9. The seal of claim 1 being substantially circular.

10. The seal of claim 1 being slightly elliptical such that upon insertion into a circular ink delivery port, the ribs press against the opposed walls.

11. An ink cartridge having an ink delivery port into which the seal of claim 1 is inserted.

12. A resilient seal for insertion into an ink delivery port of an ink cartridge of an inkjet printer, comprising:

a blind hole through which an ink supply needle of the printer can pass when the cartridge is inserted into the printer, the blind hole having a tapered opening, and closing means closing the blind hole upon removal of the cartridge from the printer.

13. A resilient seal for insertion into an ink delivery port of an ink cartridge of an inkjet printer, comprising:

a blind hole through which an ink supply needle of the printer can pass when the cartridge is inserted into the printer, wherein the blind hole has opposed walls against which the needle bears, a membrane closing the blind hole, wherein the opposed walls of the blind hole converge toward the membrane, and closing means closing the blind hole upon removal of the cartridge from the printer.

* * * * *